US009079242B2

(12) United States Patent
Kobayashi et al.

(10) Patent No.: US 9,079,242 B2
(45) Date of Patent: Jul. 14, 2015

(54) HOT-TOP FOR CONTINUOUS CASTING AND METHOD OF CONTINUOUS CASTING

(75) Inventors: Takehito Kobayashi, Miyoshi (JP); Noriyuki Ueno, Toyota (JP); Ryuuichi Masuda, Okazaki (JP); Kaoru Sugita, Fuji (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 445 days.

(21) Appl. No.: 13/203,797

(22) PCT Filed: Mar. 31, 2010

(86) PCT No.: PCT/JP2010/055849

§ 371 (c)(1),
(2), (4) Date: Aug. 29, 2011

(87) PCT Pub. No.: WO2010/114019

PCT Pub. Date: Oct. 7, 2010

(65) Prior Publication Data

US 2011/0308759 A1 Dec. 22, 2011

(30) Foreign Application Priority Data

Mar. 31, 2009 (JP) ..... 2009-085855

(51) Int. Cl.

| | |
|---|---|
| ***B22D 11/10*** | (2006.01) |
| ***B22D 11/04*** | (2006.01) |
| ***B22D 11/041*** | (2006.01) |
| *B22D 11/103* | (2006.01) |
| *B22D 11/118* | (2006.01) |

(52) U.S. Cl.

CPC ..... *B22D 11/0401* (2013.01); *B22D 11/041* (2013.01); *B22D 11/10* (2013.01); *B22D 11/103* (2013.01); *B22D 11/118* (2013.01)

(58) Field of Classification Search

CPC ..... B22D 11/0401; B22D 11/116; B22D 11/118; B22D 11/119; B22D 11/10; B22D 11/103

USPC ..... 164/437, 439

See application file for complete search history.

(56) References Cited

U.S. PATENT DOCUMENTS

| | | | | |
|---|---|---|---|---|
| 3,375,863 | A * | 4/1968 | Atkin et al. | 164/421 |
| 3,650,311 | A * | 3/1972 | Fritsche | 164/470 |
| 3,885,617 | A * | 5/1975 | Foye | 164/444 |
| 4,069,862 | A * | 1/1978 | Carson | 164/439 |
| 4,597,432 | A * | 7/1986 | Collins et al. | 164/444 |
| 4,852,632 | A * | 8/1989 | Jackson et al. | 164/437 |
| 4,875,519 | A * | 10/1989 | Ishii et al. | 164/465 |

(Continued)

FOREIGN PATENT DOCUMENTS

| | | |
|---|---|---|
| JP | 1-249241 A | 10/1989 |
| JP | 4-182046 A | 6/1992 |

(Continued)

*Primary Examiner* — Keith Walker
*Assistant Examiner* — Jacky Yuen
(74) *Attorney, Agent, or Firm* — Sughrue Mion, PLLC

(57) ABSTRACT

A hot-top is disclosed that continuously casts an ingot by pouring molten metal down into a cylindrical space in a continuous casting mold from a molten metal flow-down port. The inner shape of a flow-down port forming part corresponds to the inner shape of a cylindrical space forming part. The hot-top forms an annular groove about the molten metal flow-down port, and has a barrier between the annular groove and the flow-down port.

11 Claims, 15 Drawing Sheets

(56) References Cited

U.S. PATENT DOCUMENTS

| | | | | |
|---|---|---|---|---|
| 4,936,375 | A * | 6/1990 | Harker | 164/469 |
| 6,550,528 | B1 | 4/2003 | Ichiki et al. | |
| 2010/0051225 | A1 * | 3/2010 | Scott et al. | 164/418 |

FOREIGN PATENT DOCUMENTS

| | | | |
|---|---|---|---|
| JP | 6-292946 | A | 10/1994 |
| JP | 11-019755 | A | 1/1999 |
| JP | 2001-001111 | A | 1/2001 |

* cited by examiner

HOT-TOP FOR CONTINUOUS CASTING AND METHOD OF CONTINUOUS CASTING

CROSS REFERENCE TO RELATED APPLICATIONS

This application is a National Stage of International Application No. PCT/JP2010/055849 filed on Mar. 31, 2010, which claims priority from Japanese Patent Application No. 2009-085855, filed on Mar. 31, 2009, the contents of all of which are incorporated herein by reference in their entirety.

FIELD OF THE INVENTION

The present invention relates to a hot-top for continuous casting and a continuous casting method using the hot-top.

BACKGROUND OF THE INVENTION

Patent Documents 1, 2, and 3 disclose techniques for pouring molten metal from a chute into a casting mold that are designed to improve the quality of ingots to be casted through continuous casting.

Patent Document 1 discloses that the level of molten metal at a molten metal outlet of a melting furnace and the level of molten metal in a hot-top are made equal to each other, so that the molten metal is poured to spread the entire hot-top through a pair of left and right openings formed in a chute.

Patent Document 2 discloses that, in semi-continuous casting of an ingot having extensions, molten metal is poured into a casting mold while keeping the level of the molten metal substantially equal to the level of the molten metal in a casting mold having a hot-top. When pouring molten metal, flow adjusting plates provided in the hot-top adjust the flow of the molten metal such that it flows through the hot-top along the directions in which the extensions extend.

Patent Document 3 discloses a configuration without a hot-top, in which molten metal is supplied from a chute to a distribution pan floating on molten metal in a casting mold via a supply pipe. Molten metal in the distribution pan spouts from discharge holes of the distribution pan to be supplied to the casting mold. The distribution pan functions as a flow rate control valve of the supply pipe so that molten metal is supplied to the casting mold at a stable amount.

PRIOR ART DOCUMENTS

Patent Documents

Patent Document 1: Japanese Laid-Open Patent Publication No. 06-292946 (pages 3-4, FIG. 2)

Patent Document 2: Japanese Laid-Open Patent Publication No. 04-182046 (pages 4-5, FIG. 1)

Patent Document 3: Japanese Laid-Open Patent Publication No. 11-19755 (pages 3-4, FIG. 1)

SUMMARY OF THE INVENTION

In Patent Document 1, even though the flow of molten metal discharged from the openings of the chute will be stable without generating turbulence, the molten metal is discharged radially in all directions from the center of the hot-top. After the molten metal is discharged to the interior of the hot-top through the openings of the chute, it takes a considerable amount of time for the molten metal to reach the entire periphery, which consists of a large area in the hot-top, and the flow velocity of the molten metal will be reduced. Therefore, depending on the influence of the environment, the molten metal is likely to be cooled by a significant extent, or the temperature distribution of the molten metal is likely to be uneven. The temperature in the continuous casting mold will thus be uneven, hindering the production of high quality ingots.

In Patent Document 2, molten metal is discharged radially along the longitudinal directions of the extensions from one predetermined spot in the hot-top. The molten metal flows for a long distance within the hot-top to the distal ends of the extensions. Therefore, depending on the influence of the environment, the molten metal is likely to be cooled to a significant extent, or the temperature distribution of the molten metal is likely to be uneven. The temperature in the continuous casting mold will thus be uneven, hindering the production of high quality ingots.

The objective of Patent Document 3 is to automatically control the supply amount of molten metal. Like the other references, molten metal is discharged into the casting mold from one predetermined spot in the casting mold. It thus takes time for the molten metal to reach the entire periphery of the casing mold, and the flow velocity is reduced. Therefore, depending on the influence of the environment, the molten metal is likely to be cooled to a significant extent, or the temperature distribution of the molten metal is likely to be uneven. The temperature in the continuous casting mold will thus be uneven, hindering the production of high quality ingots.

The present invention provides a hot-top for continuous casting and a method of continuous casting that enables pouring of molten metal without causing uneven temperature distribution in a continuous casting mold when molten metal is poured from a hot-top into the continuous casting mold.

According to an aspect of the present invention, a hot-top is disclosed that continuously casts an ingot by pouring molten metal from a flow-down port into the molding space in the continuous casting mold. The inner shape of a part of the hot-top that forms the flow-down port corresponds to the inner shape of a part of the continuous casting mold that forms the molding space. The hot-top forms a molten metal introducing space about the flow-down port, and has a barrier between the molten metal introducing space and the flow-down port.

DETAILED DESCRIPTION OF THE PREFERRED EMBODIMENTS

Figure 1:
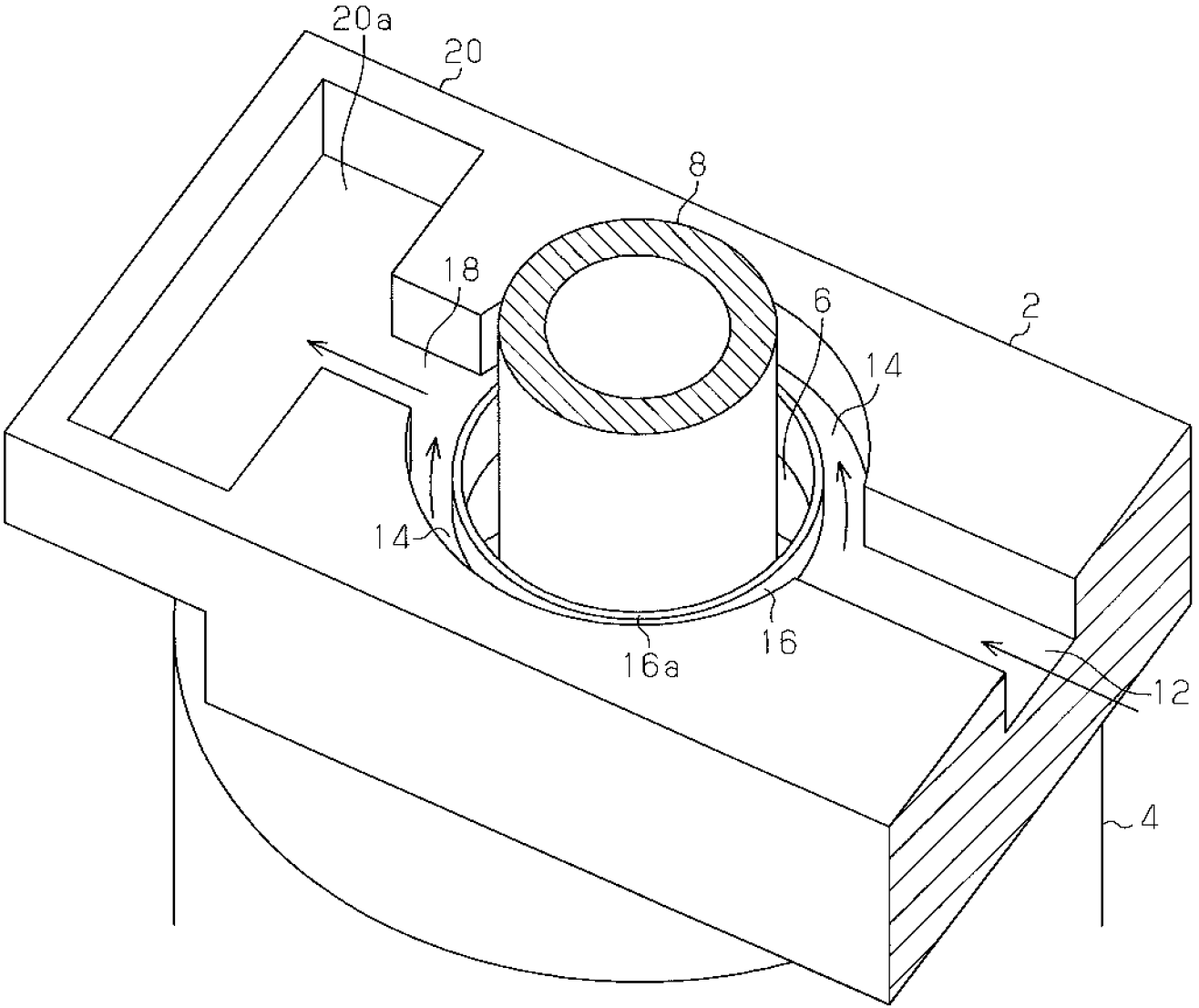
FIG. 1 is a perspective view illustrating a hot-top for continuous casting according to a first embodiment of the present invention.
Figure 2:
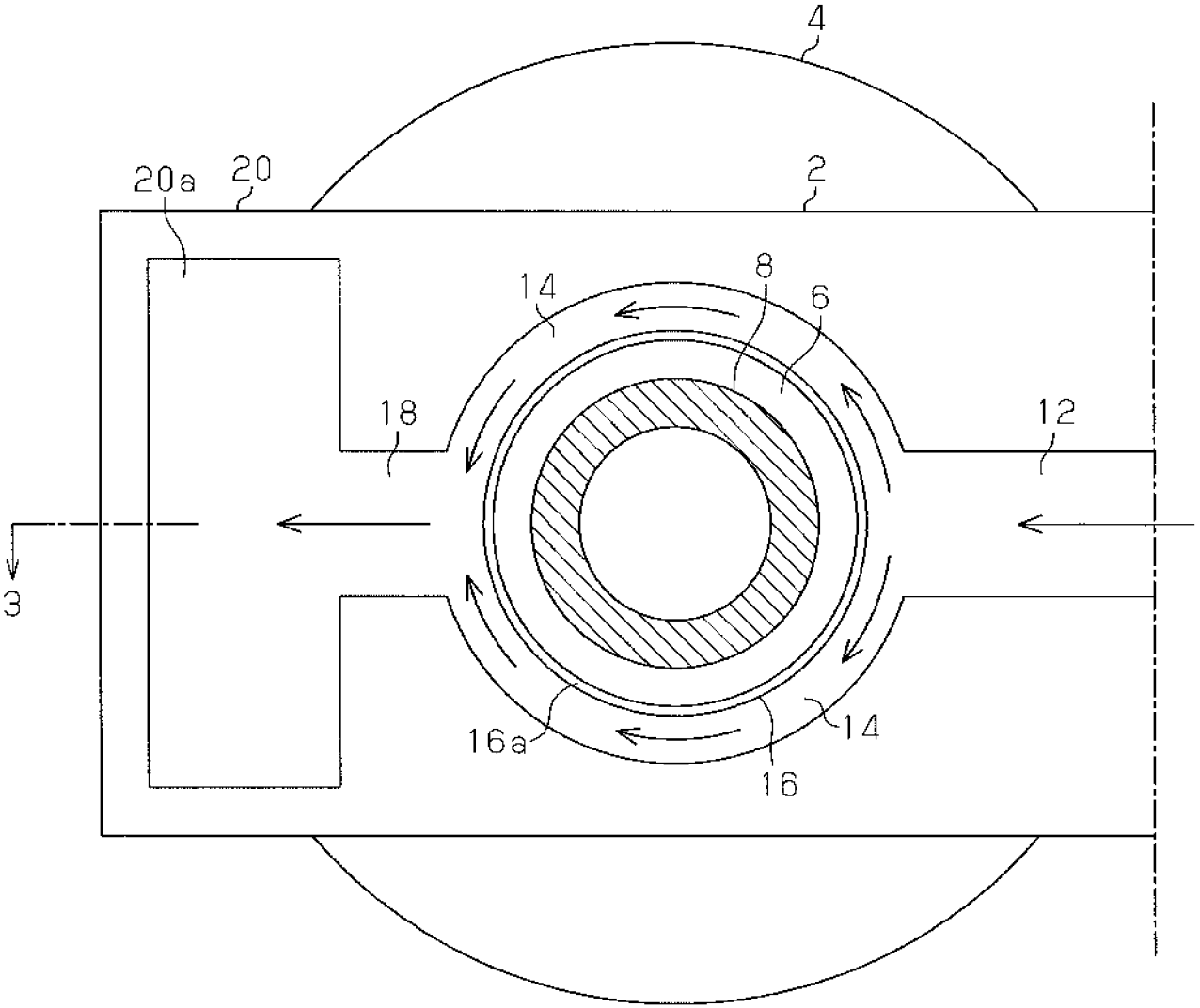
FIG. 2 is a plan view showing the hot-top for continuous casting shown in FIG. 1.
Figure 3:
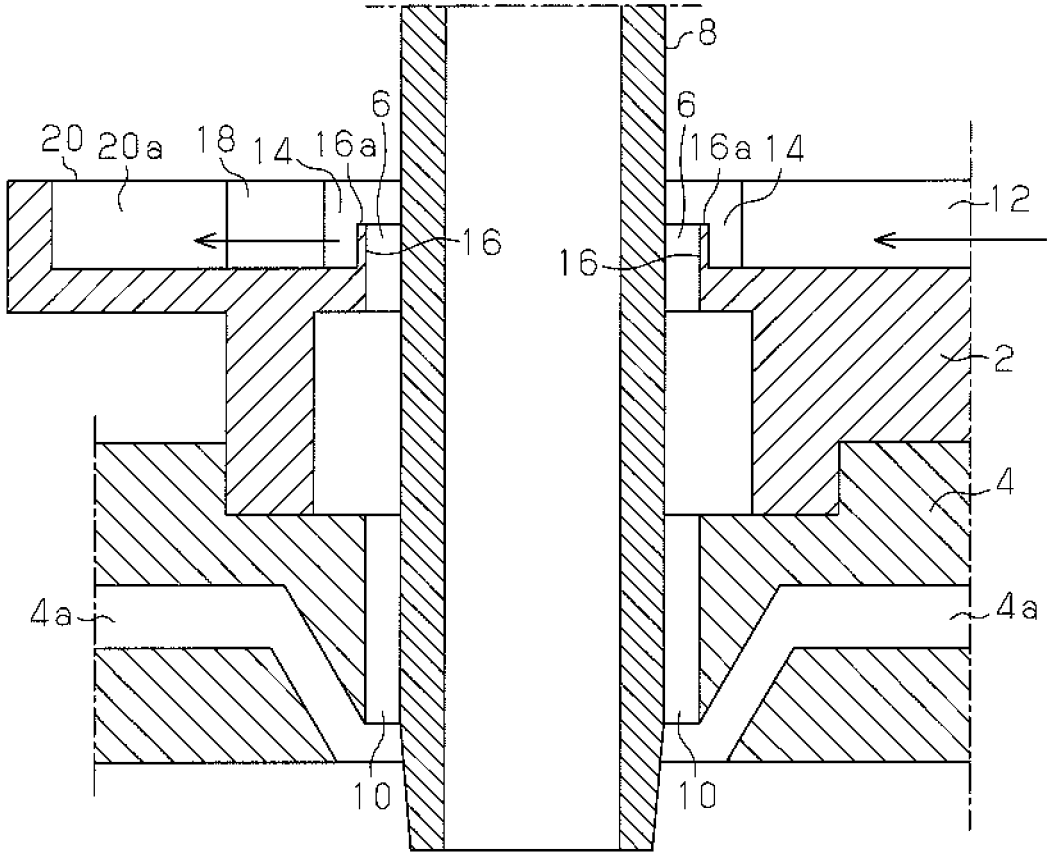
FIG. 3 is a cross-sectional view taken along line 3-3 in FIG. 2.

A hot-top 2 for continuous casting according to a first embodiment of the present invention will now be described with reference to FIGS. 1 to 4(*c*). FIG. 1 is a perspective view showing the hot-top 2 for continuous casting. FIG. 1 shows a state in which the continuous casting hot-top 2 is attached onto a continuous casting mold 4. FIG. 2 is a plan view of FIG. 1, and FIG. 3 is a cross-sectional view taken along line 3-3 of FIG. 2.

The continuous casting hot-top 2 is formed by a heat insulating material. A flow-down port 6 for molten metal is formed in a center of the continuous casting hot-top 2. In FIG. 1, a core 8, which part of the continuous casting mold 4, is suspended from above and located in the center of the flow-down port 6. Through the flow-down port 6, molten metal is supplied to the continuous casting mold 4. Molten metal is supplied to a cylindrical space 10 (molding space) between the continuous casting mold 4 made of metal and the core 8, so that the molten metal is shaped into a cylindrical shape. The molten metal is then cooled by coolant supplied from a coolant passage 4*a*, so that a cylindrical ingot is continuously casted. The inner shape of a part of the hot-top 2 that forms the flow-down port 6 corresponds to the inner shape of a part of the continuous casting mold 4 that forms the cylindrical space 10. Hereinafter, the part of the hot-top 2 that forms the flow-down port 6 will be referred to simply as a flow-down port forming part, and the part of the continuous casting mold 4 that forms the cylindrical space 10 will be referred to as a cylindrical space forming part. The configuration in which the inner shapes of these correspond to each other includes a case where the shapes are identical. However, the shapes do not necessarily have to be exactly the same, as long as the inner shape of the flow-down port 6 corresponds to the inner shape of the cylindrical space 10. For example, the inner shape of the flow-down port 6 may be slightly greater or smaller than the inner shape of the cylindrical space 10.

The continuous casting hot-top 2 receives molten metal from a melting furnace via a chute. The molten metal is, for example, molten aluminum alloy in the present embodiment. The chute supplies molten metal to a groove-shaped molten metal introducing passage 12, which is formed in the continuous casting hot-top 2.

An annular groove 14, which functions as a molten metal introducing space, is formed in a center portion of the hot-top 2 to surround the flow-down port 6. Molten metal is introduced into the annular groove 14 from the molten metal introducing passage 12. A barrier 16 is formed between the annular groove 14 and the flow-down port 6. When the level of molten metal in the annular groove 14 is lower than the height of the barrier 16, that is, as long as the amount of molten metal accumulated in the annular groove 14 is less than the maximum volume of the annular groove 14, the molten metal does not flow over the barrier 16 into the flow-down port 6.

Therefore, at an early stage of introduction of molten metal, molten metal is divided and flows around the flow-down port 6 and merges at a molten metal discharge passage 18 formed on the side opposite to the introducing passage 12. The molten metal then flows from the discharge passage 18 to a molten metal tank 20. This state is illustrated in FIG. 4(*a*).

Figure 4A:
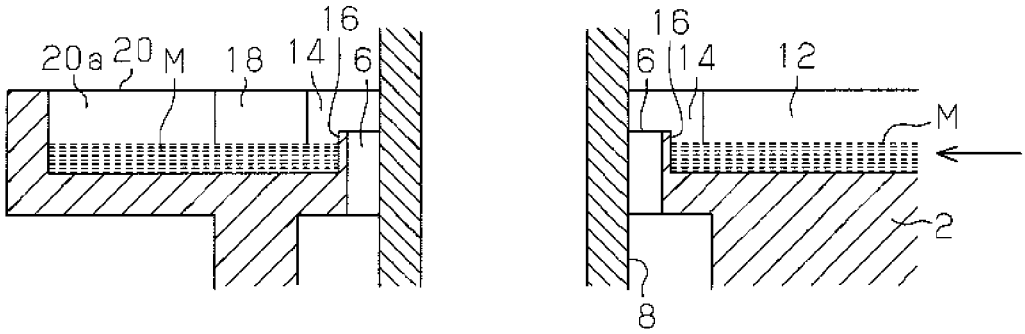
FIGS. 4(*a*), 4(*b*), and 4(*c*) are explanatory diagrams showing a way in which molten metal is introduced into the continuous casting hot-top shown in FIG. 1.
Figure 4B:
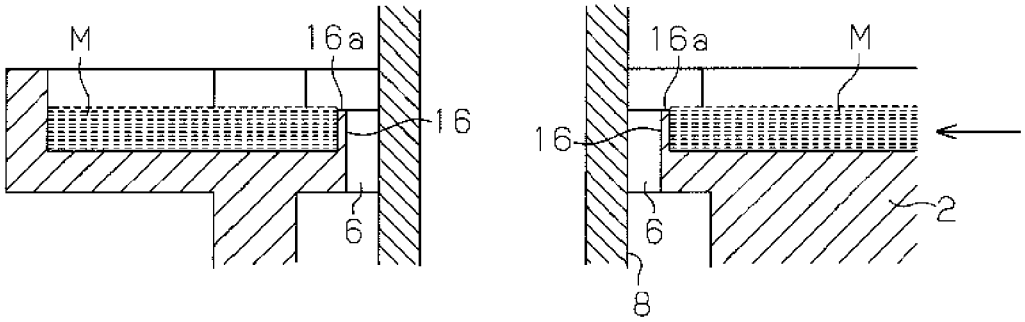
Figure 4C:
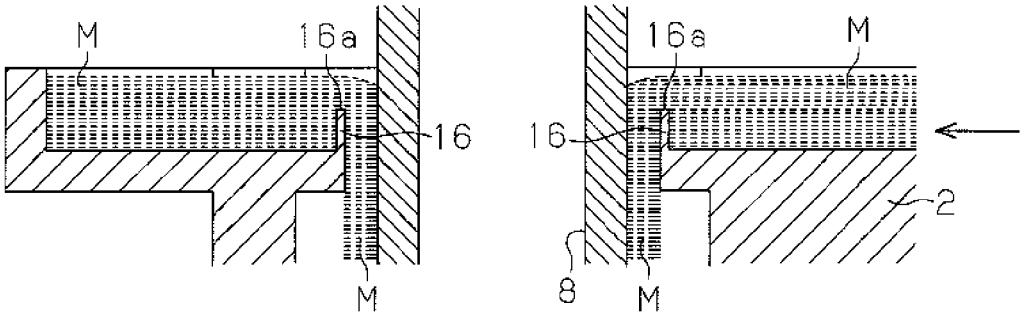

As shown in FIG. 4(*a*), molten metal M introduced via the introducing passage 12 is stored in a space 20*a* in the molten metal tank 20 via the annular groove 14 and the discharge passage 18. If the molten metal M continues being supplied from the chute to the molten metal introducing passage 12, the level of the molten metal M in the introducing passage 12, the annular groove 14, and the discharge passage 18, including the molten metal tank 20, is increased. During this time, the amount of heat of the molten metal M increases the temperature of the continuous casting hot-top 2. Particularly, since the annular groove 14 allows the molten metal M to flow about the flow-down port 6, the temperature at parts about the flow-down port 6, for example, the barrier 16 is increased. As a working process, the process thus far from the start of introduction of the molten metal M from the introducing passage 12 corresponds to a casting preparation step.

Thereafter, the molten metal M continues to be accumulated. When the level of the molten metal M reaches the horizontally formed tip 16*a* of the barrier 16 over the entire circumference of the annular groove 14 as shown in FIG. 4(*b*), the molten metal M flows over the barrier 16 as shown in FIG. 4(*c*) into the continuous casting mold 4. Accordingly, the molten metal M flows through the cylindrical space 10 to be cooled by coolant. An ingot is pulled down from below the continuous casting mold 4 so that a cylindrical ingot is continuously casted. As a working process, the process from when the molten metal M is caused to continuously overflow from the barrier 16 to when the molten metal M flows to the continuous casting mold 4 corresponds to a step of molten metal flowing down.

The present embodiment has the following advantages.

(1) The barrier 16, which is formed between the annular groove 14 and the molten metal flow-down port 6, prevents molten metal introduced into the annular groove 14 from flowing down into the continuous casting mold 4 via the flow-down port 6 at an early stage of the introduction. Further, the molten metal tank 20 allows the molten metal to flow into the space 20*a* in the tank 20 through the discharge passage 18. Therefore, at an early stage of introduction of molten metal, molten metal is discharged to the tank 20, which suppresses the rate of increases in the level of the molten metal M. The state continues for a while in which the molten metal M is prevented from being poured into the continuous casting mold 4.

Thereafter, when the level of the molten metal M reaches the tip 16*a* of the barrier 16, the molten metal M starts overflowing the barrier 16, and the overflowed amount of molten metal flows down into the continuous casting mold 4.

Therefore, at an early stage of introduction of molten metal, molten metal does not flow down through the flow-down port 6 but flows through the annular groove 14, so that the temperature of the continuous casting hot-top 2, particularly the temperature of the barrier 16, is efficiently increased. Thus, molten metal that flows into the introducing passage 12 overflows the barrier 16 and flows into the continuous casting mold 4, while maintaining a sufficiently high temperature.

Further, the inner shape of the flow-down port forming part corresponds to the inner shape of the cylindrical space forming space. In the present embodiment, the inner shape of the flow-down port forming part and the inner shape of the cylindrical space forming part are substantially the same. Therefore, molten metal that overflows and flows down from the barrier 16 is smoothly poured in over the entire circumference of the cylindrical space 10, without generating turbulences. As a result, molten metal the temperature of which is maintained sufficiently high is supplied to the cylindrical space 10 of the continuous casting mold 4.

This prevents the temperature in the continuous casting mold 4 from being uneven when molten metal is poured into the continuous casting mold 4 from the continuous casting hot-top 2. Therefore, the surface property or the inner property become even, so that a cylindrical ingot having a sufficiently high quality can be manufactured.

(2) The molten metal introducing passage 12 and the molten metal discharge passage 18 are at opposite positions with the flow-down port 6 in between. This allows molten metal introduced into the annular groove 14 from the molten metal introducing passage 12 to flow evenly around the flow-down port 6, so that the temperature of the part about the flow-down port 6 will be evenly increased.

(3) In the present embodiment, since the core 8 is used in the continuous casting mold 4, the inner diameter of the cylindrical space forming part tends to be large. Also, a hollow ingot, which is cylindrical in the present embodiment, is manufactured. Because of the above listed advantages, the temperature is evenly controlled over the entire circumference, which allows high quality ingots to be manufactured.

A second embodiment of the present invention will now be described with reference to FIGS. 5(*a*) to 5(*c*). In the first embodiment described above, the bottom of the molten metal introducing passage 12, the bottom of the annular groove 14, the bottom of the molten metal discharge passage 18, and the bottom of the molten metal tank 20 are on the same horizontal plane as each other, and the entire structures are also on the same horizontal plane. In the present embodiment, the bottoms are inclined or stepped as shown in FIG. 5.

Figure 5A:
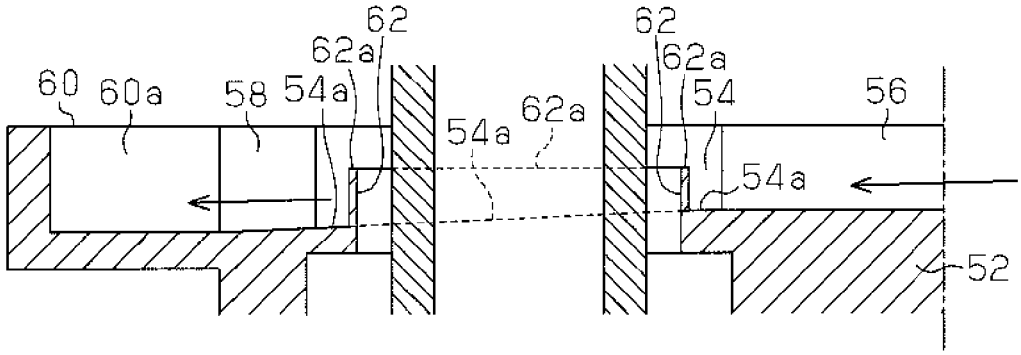
FIGS. 5(*a*), 5(*b*), and 5(*c*) are vertical cross-sectional views illustrating a hot-top for continuous casting according to a second embodiment of the present invention.
Figure 5B:
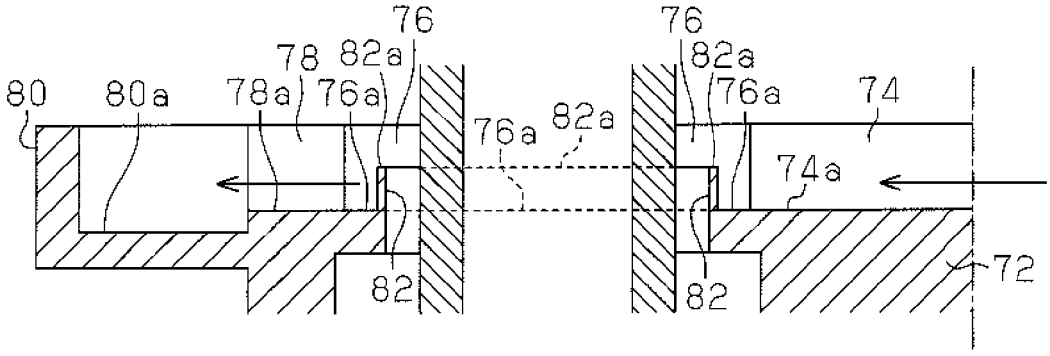
Figure 5C:
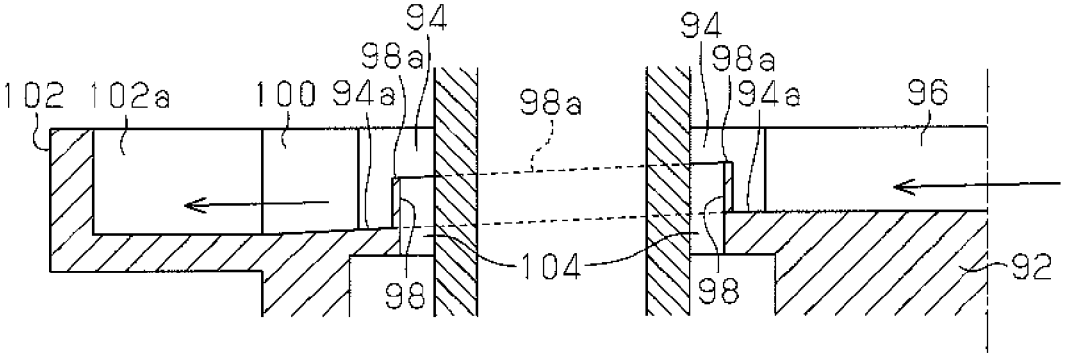

A continuous casting hot-top 52 shown in FIG. 5(*a*) has an annular groove 54, the bottom 54*a* of which is inclined in relation to the bottom of a molten metal introducing passage 56 and the bottom of a molten metal tank 60. The bottom 54*a* is highest at a part (introducing part) connected to the molten metal introducing passage 56 and inclined downward from there toward the molten metal discharge passage 58.

As indicated by the arrows in FIG. 5(*a*), molten metal introduced from the molten metal introducing passage 56 quickly flows through the annular groove 54 and reaches the molten metal discharge passage 58. By its momentum, the molten metal flows into the space 60*a* in the molten metal tank 60.

Thereafter, the introduction of molten metal from the introducing passage 56 continues. When the level of the molten metal reaches and exceeds the tip 62*a* of the barrier 62, the molten metal flows down into the continuous casting mold, so that continuous casting starts.

In the continuous casting hot-top 52, at an early stage of introduction of molten metal, molten metal quickly flows to be distributed to the entire annular groove 54. This quickly and evenly increases the temperature of the whole annular groove 54 before continuous casting starts.

A continuous casting hot-top 72 shown in FIG. 5(*b*) has a molten metal introducing passage 74, an annular groove 76, and a molten metal discharge passage 78, which have bottoms 74*a*, 76*a*, and 78*a*, respectively. The bottoms 74*a*, 76*a*, and 78*a* are on the same horizontal plane, and the entire structures are also on the same horizontal plane. The bottom 80*a* of a molten metal tank 80 is horizontal, but its height is lower than that of the bottoms 74*a*, 76*a*, and 78*a* of the molten metal introducing passage 74, the annular groove 76, and the molten metal discharge passage 78.

Therefore, molten metal introduced from the introducing passage 74 is stored in the tank 80, and the stored amount is greater than that in the first embodiment by an amount corresponding to the difference between the height of the bottom 80*a* of the tank 80 and the height of the bottoms 74*a*, 76*a*, 78*a*. After being introduced into the molten metal tank 80, the level of molten metal reaches the tip 82*a* of the barrier 82. When the level exceeds the level of the tip 82*a*, the molten metal flows down into the continuous casting mold 4, so that continuous casting starts.

In the continuous casting hot-top 72, even if the molten metal introducing passage 74, the annular groove 76, and the molten metal discharge passage 78 need to be formed shallow for some reason, the height of the bottom 80*a* of the molten metal tank 80 can be adjusted appropriately, such that a sufficient amount of molten metal can be supplied to the annular groove 76, before the molten metal flows over the barrier 82 to start continuous casting. This quickly and evenly increases the temperature of the whole annular groove 76 before continuous casting starts.

A continuous casting hot-top 92 shown in FIG. 5(*c*) has an annular groove 94, the bottom 94*a* of which is inclined in relation to the bottom of a molten metal introducing passage 96 and the bottom of a molten metal tank 102. This hot-top 92 is the same as the hot-top 52 shown in FIG. 5(*a*) in that the bottom 94*a* is highest at a part (introducing part) connected to the molten metal introducing passage 96 and inclined from there downward toward the molten metal discharge passage 100.

The difference from the continuous casting hot-top 52 shown in FIG. 5(*a*) is that, like the bottom 94*a* of the annular groove 94, the tip 98*a* of a barrier 98 is inclined relative to the bottom of the introducing passage 96 and the bottom of the tank 102, such that a part of the tip 98*a* that corresponds to the introducing passage 96 (introducing part) is the highest and is gradually lowered toward a discharge passage 100. The degree of inclination of the tip 98*a* is not necessarily the same as the degree of inclination of the bottom 94*a*.

As indicated by arrows, molten metal introduced from the molten metal introducing passage 96 quickly flows through the annular groove 94 and reaches the molten metal discharge passage 100. By its momentum, the molten metal flows into the space 102*a* in the molten metal tank 102. At an early stage of introduction of molten metal, molten metal quickly flows to be distributed to the entire annular groove 94. This quickly and evenly increases the temperature of the whole annular groove 94 before continuous casting starts, as in the continuous casting hot-top 52 shown in FIG. 5(*a*).

However, in the continuous casting hot-top 52 shown in FIG. 5(*a*), molten metal introduced from the introducing passage 56 hits the barrier 62 at a high flow rate. This causes the level of the molten metal at a part in the annular groove 54 close to the introducing passage 56 to be higher than the level of molten metal at a part close to the discharge passage 58 in some cases. This results in an inclined level of molten metal in the annular groove 54. In other cases, due to low fluidity of molten metal, the level of molten metal in a part of the annular groove 54 close to the molten metal introducing passage 56 is higher than the level of molten metal at a part close to the molten metal discharge passage 58, so that the level of molten metal in the annular groove 54 is inclined.

In contrast, the tip 98*a* of the barrier 98 in the continuous casting hot-top 92 shown in FIG. 5(*c*) is inclined to correspond to inclination of the level of molten metal in the annular groove 94, so that the amount of molten metal that flows over the barrier 98 and into the flow-down port 104 is uniform over the entire circumference of the flow-down port 104. Accordingly, ingots of improved quality can be obtained.

Figure 6:
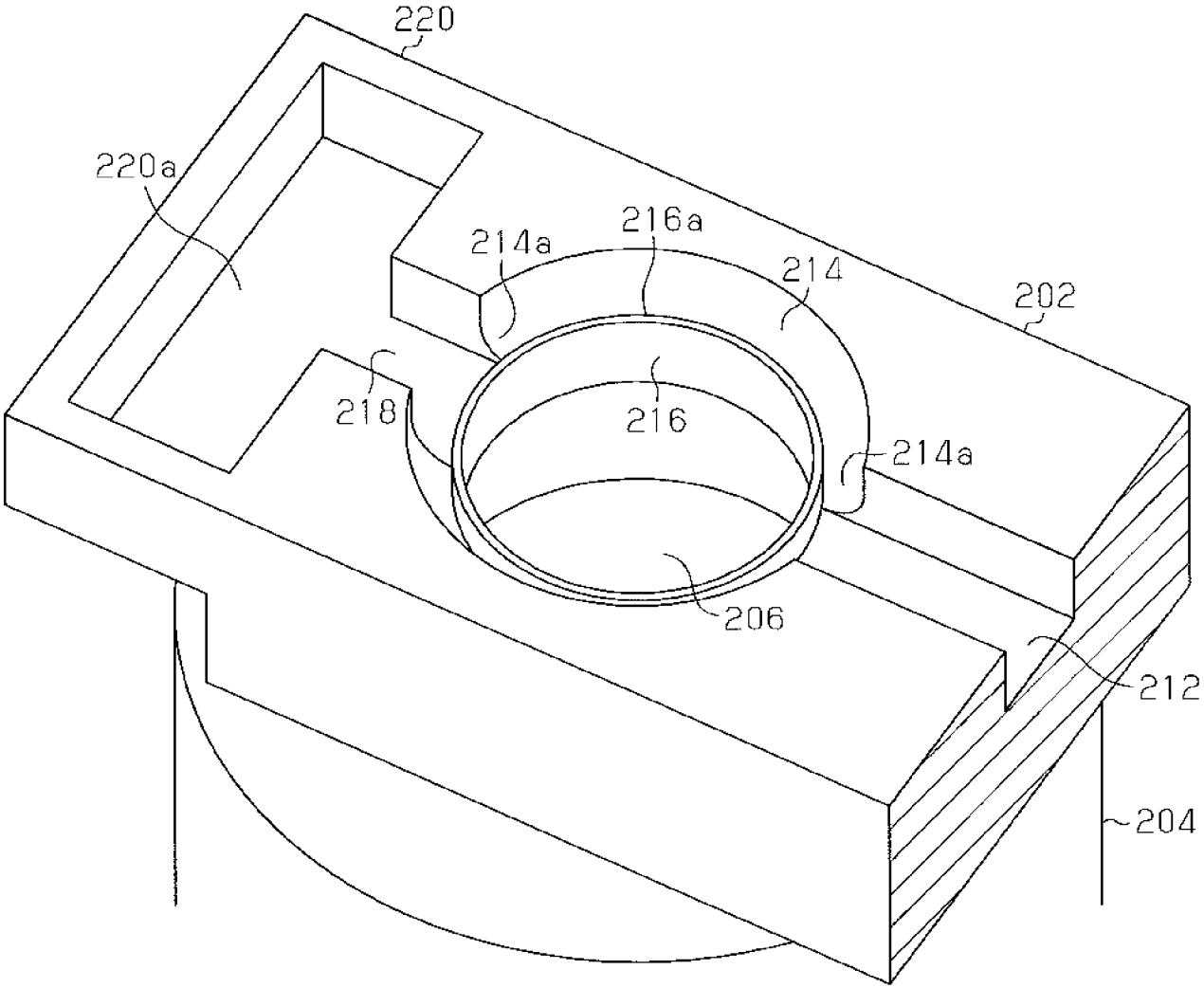
FIG. 6 is a perspective view illustrating a hot-top for continuous casting according to a third embodiment of the present invention.
Figure 7:
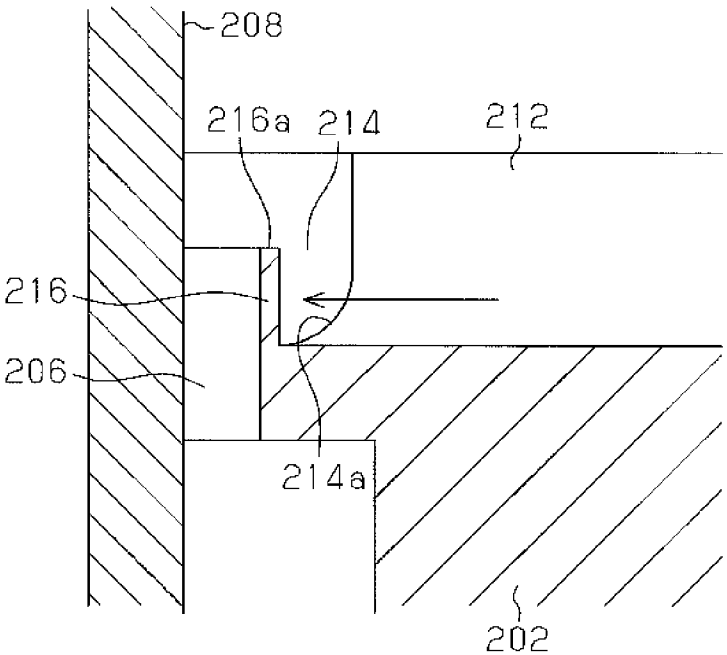
FIG. 7 is a vertical cross-sectional view illustrating a hot-top for continuous casting according to the third embodiment of the present invention.
Figure 7:
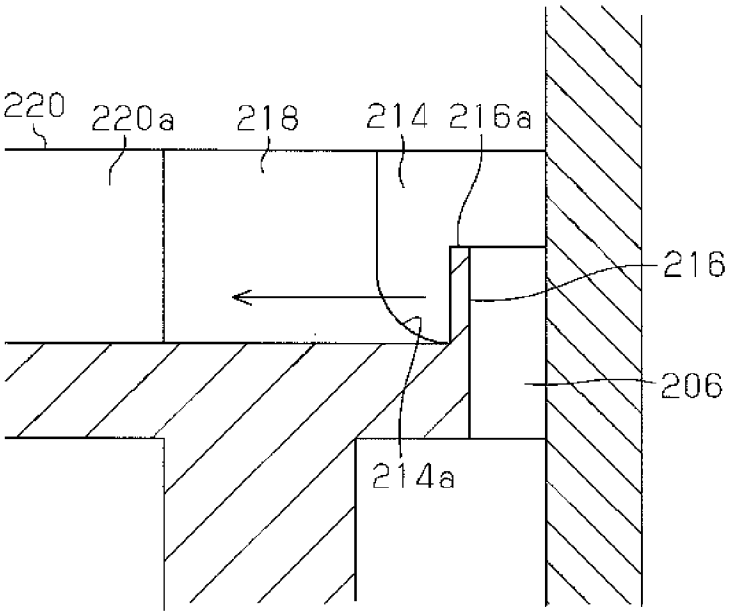

Next, a hot-top 202 for continuous casting according to a third embodiment of the present invention will be described with reference to FIGS. 6 and 7. FIG. 7 is a vertical cross-sectional view of FIG. 6. FIG. 6 shows a state in which a core 208 is yet to be attached.

The third embodiment is the same as the first embodiment except for the shape of the bottom 214*a* of an annular groove 214. Specifically, the depth of the annular groove 214 gradually decreases toward the radially outer end from the barrier 216. In other words, the bottom 214*a* of the annular groove 214 gradually rises as the distance from the barrier 216 increases.

As indicated by arrows in the cross-sectional view of FIG. 7, when molten metal is introduced into the annular groove 214 from a molten metal introducing passage 212, the molten metal flows in a concentrated manner in a part of the bottom 214*a* of the annular groove 214 that is close to the barrier 216, where the depth of the annular groove 214 is great. The molten metal is then discharged to a space 220*a* in the molten metal tank 220 via a molten metal discharge passage 218.

Thereafter, when the level of the molten metal in the annular groove 214 and the space 220*a* in the tank 220 rises and exceeds the tip 216*a* of the barrier 216, molten metal flows down into the continuous casting mold 204 from the entire circumference of the flow-down port 206.

The present embodiment has the following advantage in addition to the advantages (1) to (3) of the first embodiment.

(4) At an early stage of introduction of molten metal, the temperature of a part of the bottom 214*a* of the annular groove 214 close to the barrier 216 can be quickly increased and the rate of supply of molten metal at the start of introduction of the molten metal can be increased. This enables continuous casting of an improved efficiency.

Figure 8:
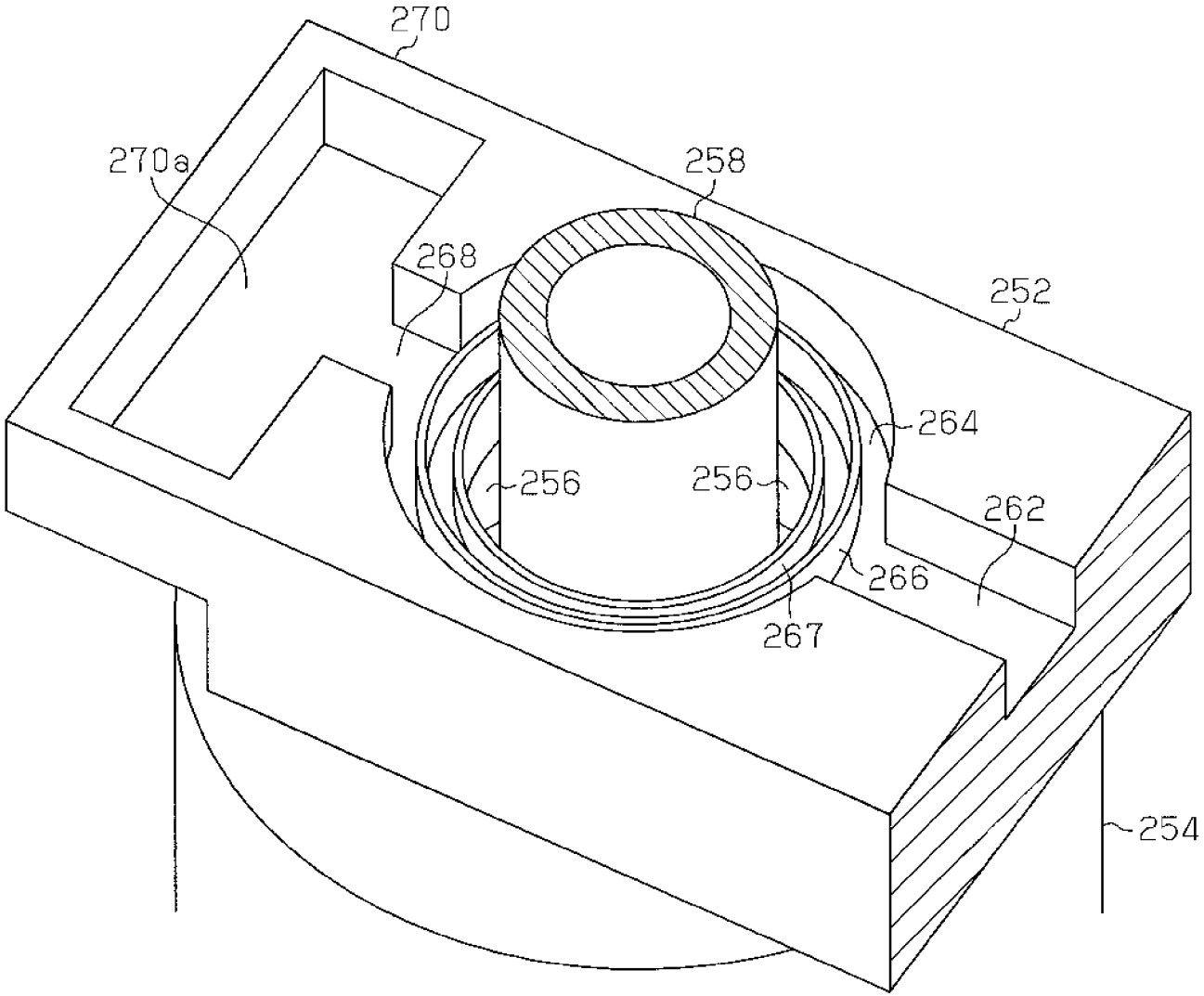
FIG. 8 is a perspective view illustrating a hot-top for continuous casting according to a fourth embodiment of the present invention.
Figure 9:
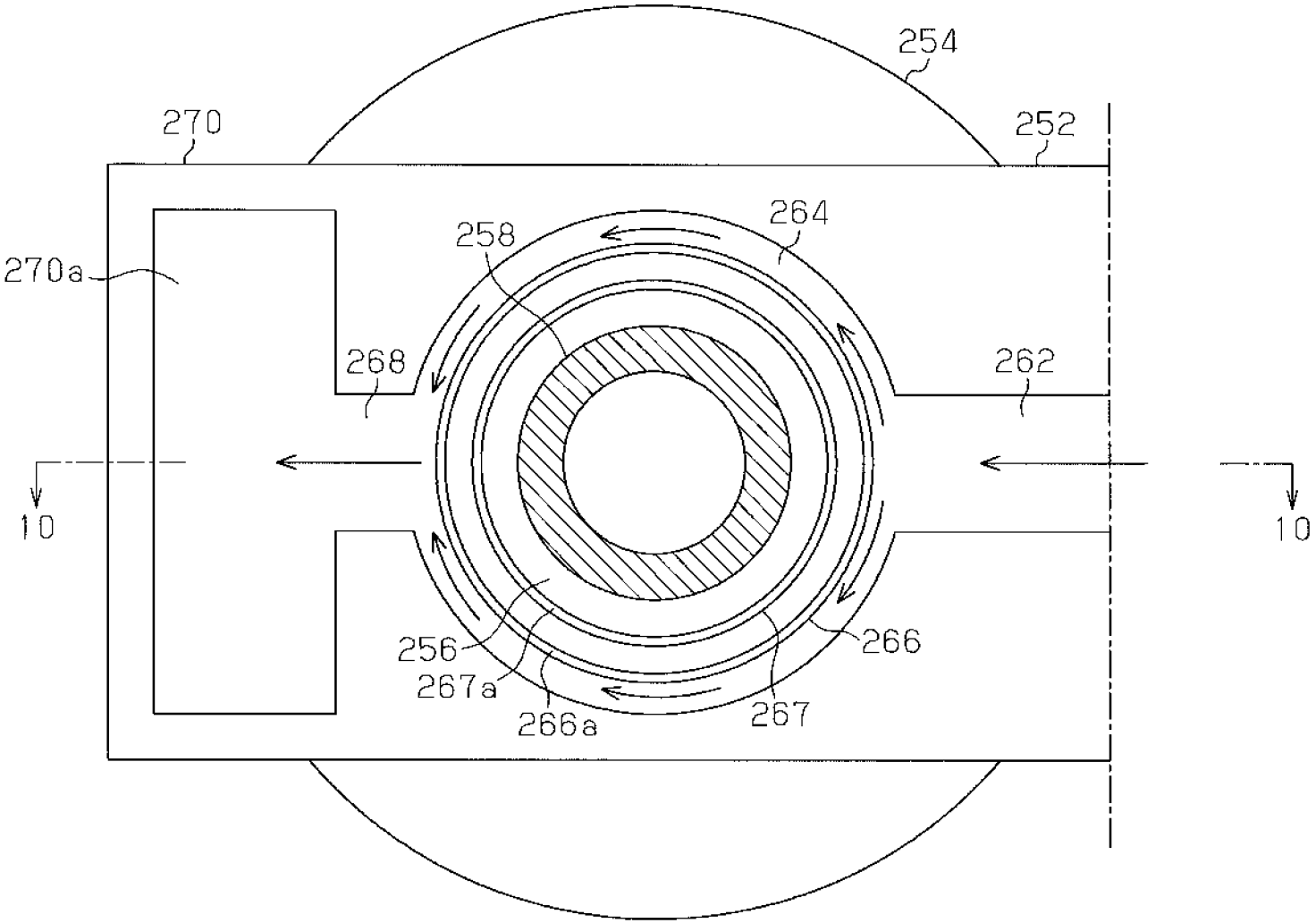
FIG. 9 is a plan view showing the hot-top for continuous casting shown in FIG. 8.

Next, a hot-top 252 for continuous casting according to a fourth embodiment of the present invention will now be described with reference to FIGS. 8, 9 and 10(*a*) to 10(*c*). As shown in FIGS. 8 and 9, the present embodiment is different from the first embodiment in that a continuous casting hot-top 252 of the present embodiment has a first barrier 266 and a second barrier 267 in an annular groove 264. The second barrier 267 is located radially inside of the first barrier 266. The remainder of the configuration is the same as those of the first embodiment.

At an early stage of introduction of molten metal, molten metal flows from a molten metal introducing passage 262 to a space in the annular groove 264 that is radially outside of the first barrier 266 as indicated by arrows in FIG. 9. The molten metal then flows to a space 270*a* in a molten metal tank 270 via a molten metal discharge passage 268.

Figure 10A:
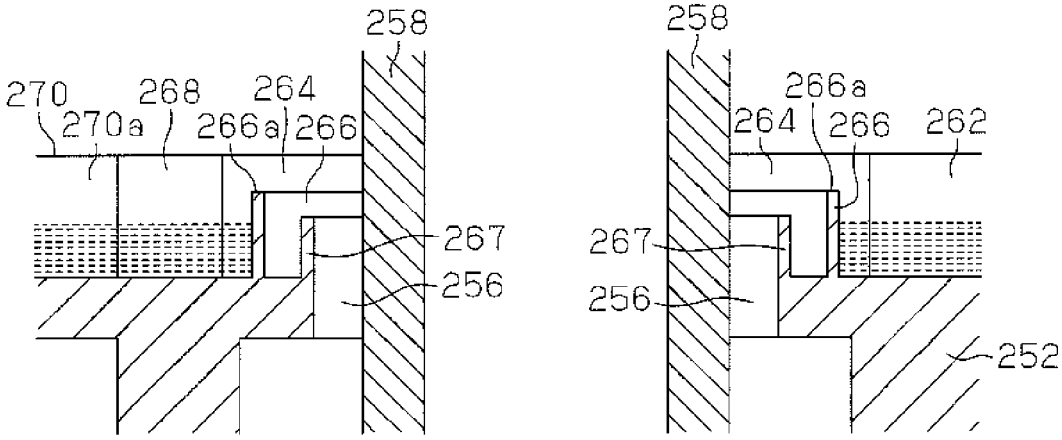
FIGS. 10(*a*), 10(*b*), and 10(*c*) are explanatory diagrams showing a way in which molten metal is introduced into the continuous casting hot-top shown in FIG. 8.
Figure 10B:
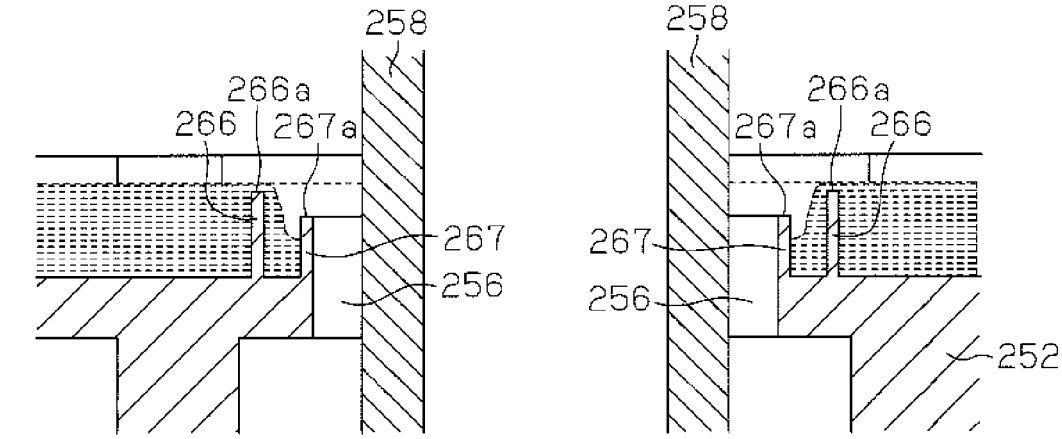
Figure 10C:
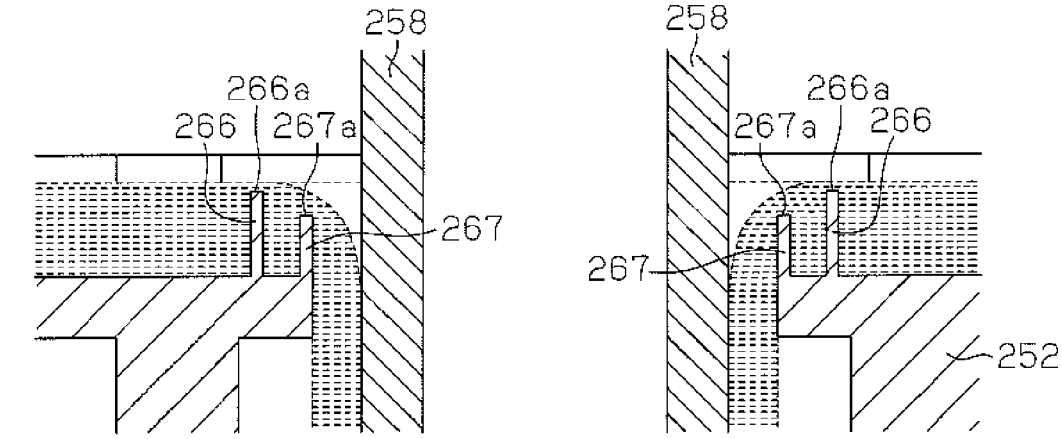

Therefore, at an early stage of introduction of molten metal, the level of molten metal is as shown in the vertical cross-sectional view of FIG. 10(*a*), and the molten metal does not flow to the space between the first barrier 266 and the second barrier 267 or a flow-down port 256. FIG. 10(*a*) is a cross-sectional view taken along line 10-10 of FIG. 9.

When the level of molten metal introduced from the introducing passage 262 rises and exceeds the tip 266*a* of the first barrier 266, the molten metal flows into the space between the first barrier 266 and the second barrier 267 in the annular groove 264 as shown in FIG. 10(*b*).

For a certain period, the state continues in which the molten metal flows into the space between the first barrier 266 and the second barrier 267 in the annular groove 264. Then, when the level of molten metal exceeds the tip 267*a* of the second barrier 267 as shown in FIG. 10(*c*), molten metal flows into the flow-down port 256, so that continuous casting in the continuous casting mold 254 having a core 258 starts.

The present embodiment has the following advantage in addition to the advantages (1) to (3) of the first embodiment.

(5) A plurality of barriers (the first barrier 266 and the second barrier 267) is provided in the annular groove 264. Thus, even if the amount distribution of molten metal when exceeding the tip 266*a* of the first barrier 266 is uneven and not uniform over the entire circumference, the space between the first barrier 266 and the second barrier 267 suppresses such uneven distribution. Thus, when molten metal exceeds the tip 267*a* of the inner second barrier 267, which is formed horizontal, the molten metal flows into the flow-down port 256 at a uniform flow rate over the entire circumference.

This further promotes the uniformity of the temperature in the continuous casting mold 254. Accordingly, ingots of improved quality can be obtained.

Figure 11:
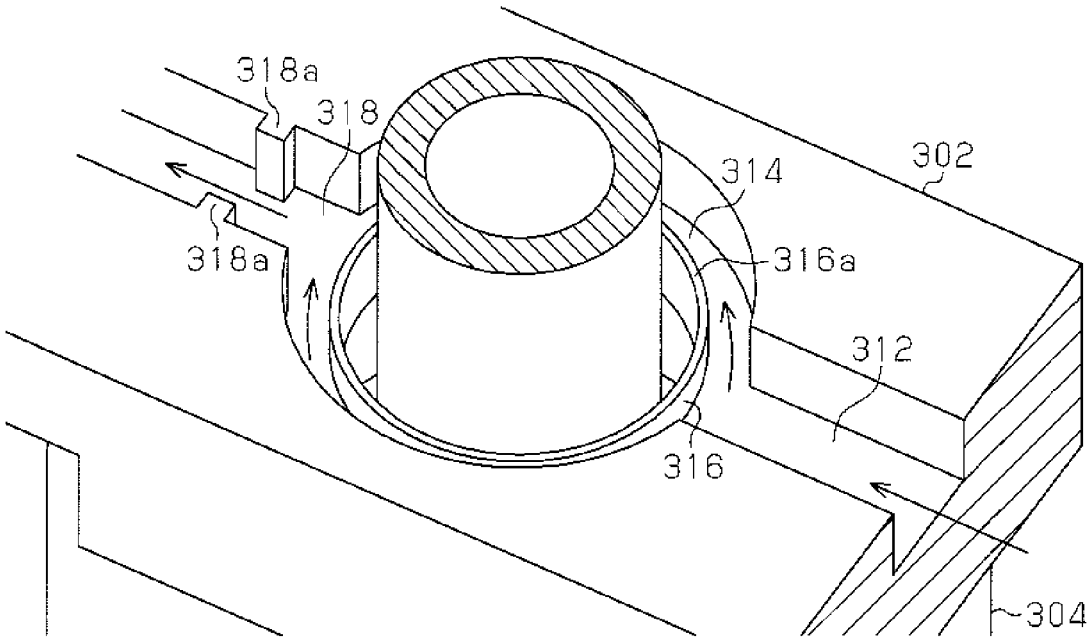
FIGS. 11(*a*) and 11(*b*) are explanatory perspective views showing operation of a hot-top for continuous casting according to a fifth embodiment of the present invention.
Figure 11:
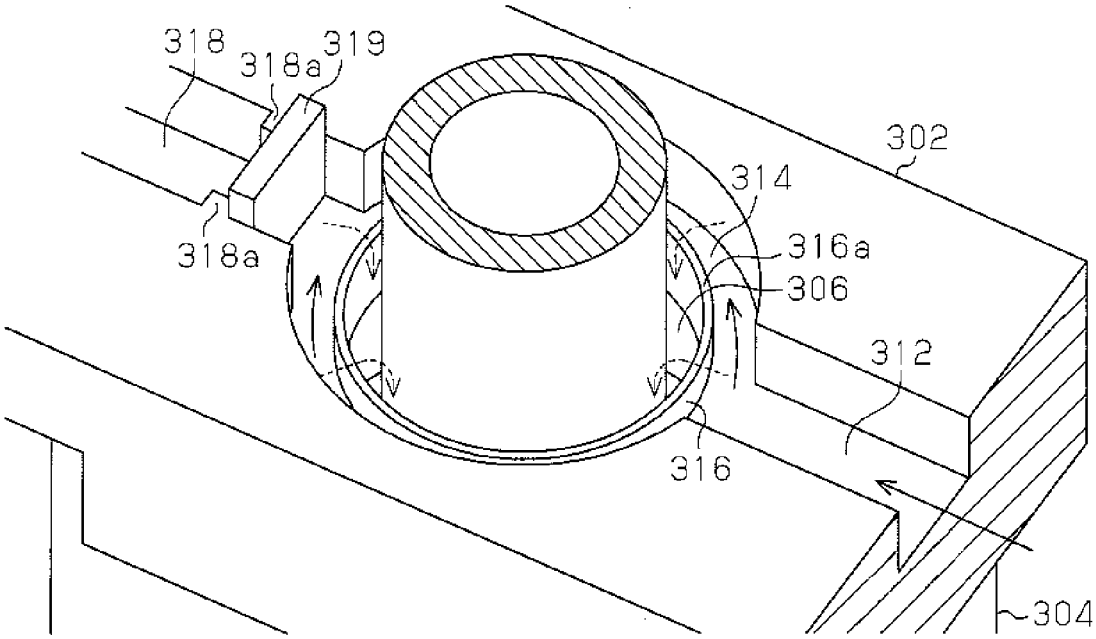

Next, a hot-top 302 for continuous casting according to a fifth embodiment of the present invention will be described with reference to FIGS. 11(*a*) and 11(*b*). Unlike the first embodiment, the continuous casting hot-top 302 of the present embodiment does not have a molten metal tank 20 as shown in FIG. 11(*a*). A pair of projections 318*a* is formed on side walls of a molten metal discharge passage 318. An open/close member 319 is located upstream of the pair of projections 318*a*. At an early stage of introduction of molten metal, molten metal introduced from an introducing passage 312 flows around a annular groove 314, which is formed to surround a flow-down port 306 and to the discharge passage 318. The molten metal is then immediately discharged from the hot-top 302. The molten metal, which has warmed the hot-top 302 and thus has been cooled, is discharged from the hot-top 302.

Thereafter, as shown in FIG. 11(*b*), the open/close member 319 is provided on the upstream side of the projections 318*a* formed in the discharge passage 318. When the open/close member 319 is switched from an open state to a closed state, the discharge passage 318 is switched from an open state to a closed state.

When the discharge passage 318 is switched to the closed state, discharge of molten metal is stopped, so that the level of molten metal in the continuous casting hot-top 302 gradually rises. Then, as indicated by arrows of broken lines, the molten metal flows over the tip 316*a* of the barrier 316. Accordingly, the molten metal flows down into the flow-down port 306, so that continuous casting in the continuous casting mold 304 starts.

The present embodiment has the following advantage in addition to the advantages (2) and (3) of the first embodiment.

(6) The barrier 316, which is formed between the annular groove 314 and the flow-down port 306, retains molten metal, and the discharge passage 318 discharges molten metal. This prevents molten metal from flowing into the continuous casting mold 304 from the flow-down port 306 at an early stage of introduction of molten metal. Therefore, at an early stage of introduction of molten metal, molten metal does not flow down through the continuous casting mold 304 but flows through the annular groove 314. During this time, the temperature of the continuous casting hot-top 302, that is, the temperature of the barrier 316, is efficiently increased. The temperature raising period can be arbitrarily set by setting the closing timing at which the discharge passage 318 is closed by the open/close member 319. Therefore, an operation for making the temperature uniform of molten metal flowing down into the continuous casting mold 304 can be flexibly modified.

When the discharge passage 318 is closed by the open/close member 319 after an arbitrarily set temperature rising period, the molten metal that is introduced thereafter flows over the barrier 316 and into the continuous casting mold 304, while maintaining a sufficiently high temperature. Accordingly, the molten metal is poured in as a smooth flow over the entire circumference of the continuous casting mold 304.

This prevents the temperature in the continuous casting mold 304 from being uneven when molten metal is poured into the continuous casting mold 304 from the continuous casting hot-top 302. Therefore, the surface property or the inner property become even, so that a cylindrical ingot having a sufficiently high quality can be manufactured.

In the first to fifth embodiments, the molten metal introducing passages and the molten metal discharge passages are formed to have constant width. In contrast, according to the present embodiment, a continuous casting hot-top 352 shown in FIG. 12 has a molten metal introducing passage 362, in which a part that is connected to an annular groove 364 has a gradually increasing width. Also, the connecting part has no angles and is formed smooth. Accordingly, molten metal that is introduced from the introducing passage 362 smoothly flows into the annular groove 364 without generating turbulence, and head-on collision of molten metal against the barrier 366 is weakened. This configuration prevents molten metal from flowing over a part of the barrier 366 that is close to the introducing passage 362 at an early stage of introduction of molten metal. The configuration also prevents the amount of molten metal from being uneven over the circumference of the barrier 366 when the molten metal flows over the barrier 366. Accordingly, the temperature of molten metal in the continuous casting mold 354 is prevented from being uneven, and a sufficiently high quality ingot can be continuously casted.

Figure 12:
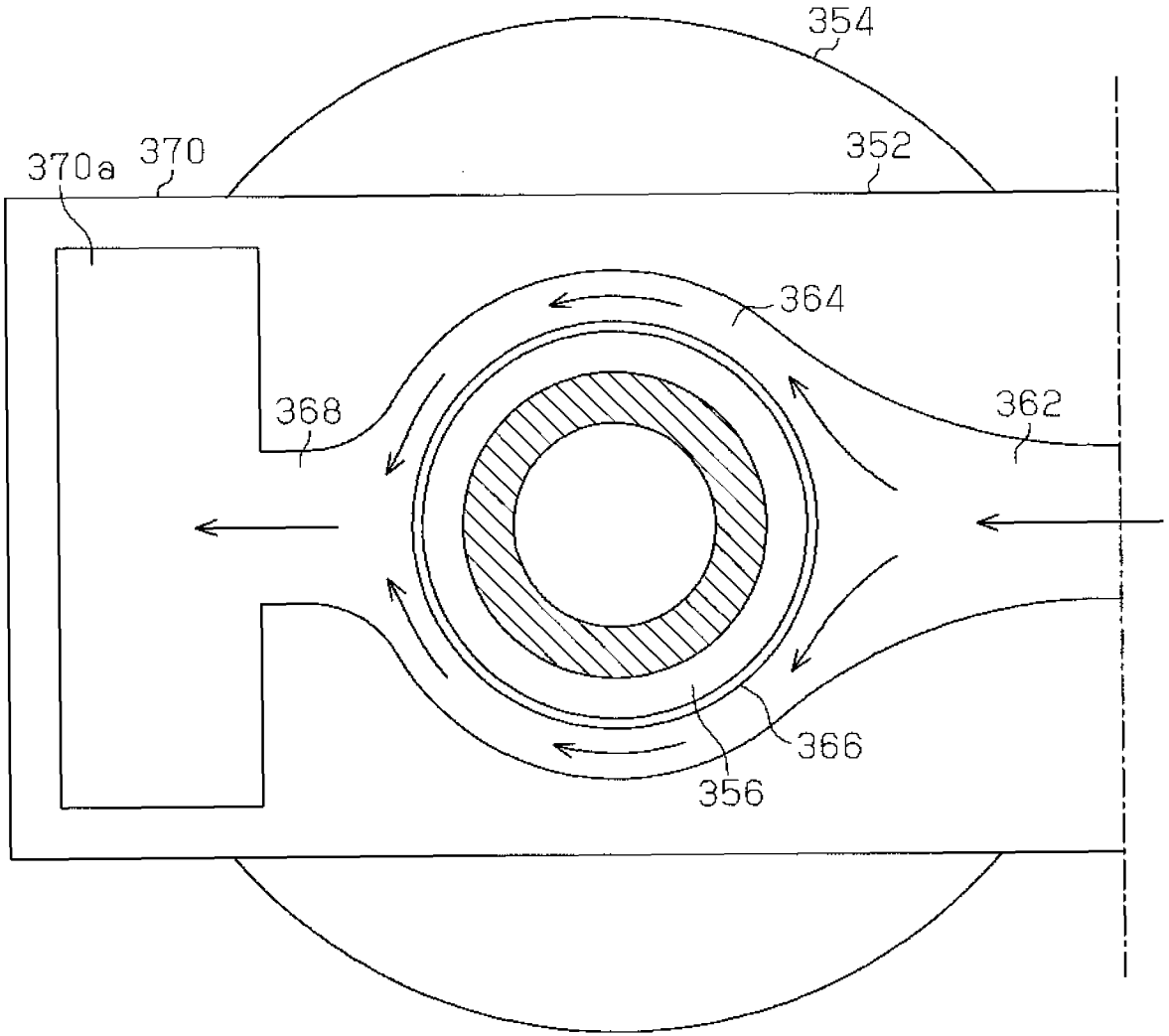
FIG. 12 is a plan view showing a hot-top for continuous casting according to a modified embodiment.

Further, in the embodiment shown in FIG. 12, parts of the discharge passage 368 that are connected to the annular groove 364 are not formed as angles, but are smoothly connected to the annular groove 364. This allows molten metal to be smoothly discharged to the space 370*a* in a molten metal tank 370 from the annular groove 364 via the discharge passage 368, and collision of flows of molten metal at a convergence position, where molten metal converges and flows into the discharge passage 368, is weakened. This configuration prevents molten metal from flowing over a part of the barrier 366 that is close to the discharge passage 368 at an early stage of introduction of molten metal and down into the flow-down port 356. The configuration also prevents the amount of molten metal from being uneven over the circumference of the barrier 366 when the molten metal flows over the barrier 366. Accordingly, the temperature of molten metal in the continuous casting mold 354 is prevented from being uneven, and a sufficiently high quality ingot can be continuously casted.

In each of the first to fifth embodiments, there are provided one molten metal introducing passage and one molten metal discharge passage. However, the number of the passages may be two or more. In a continuous casting hot-top 402 shown in the plan view of FIG. 13, two molten metal introducing passages 412, 413 and two molten metal discharge passages 418, 419 are provided. In correspondence with the discharge passages 418, 419, two molten metal tanks 420, 421 having spaces 420*a*, 421*a* are provided.

Figure 13:
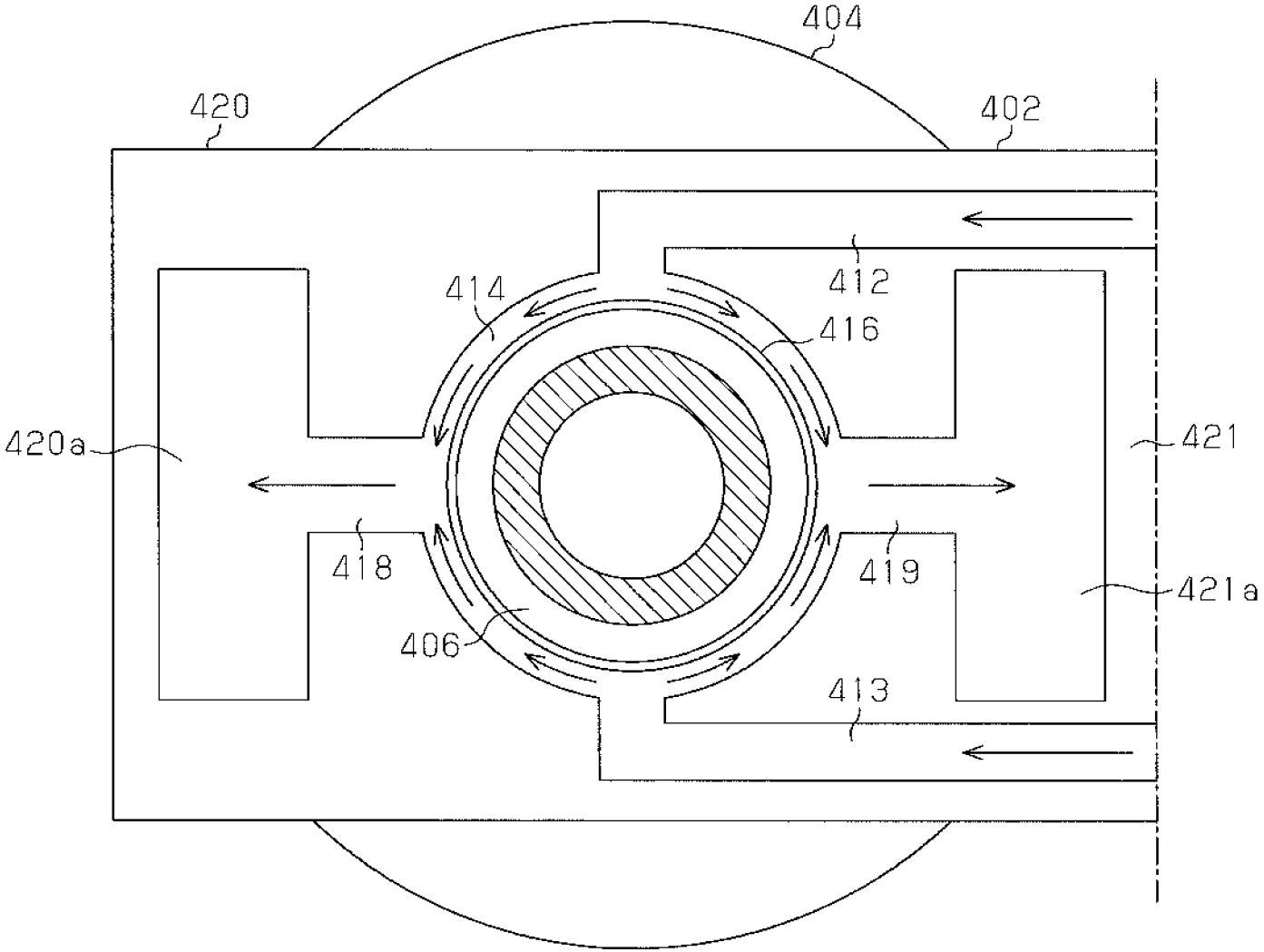
FIG. 13 is a plan view showing a hot-top for continuous casting according to a modified embodiment.

In FIG. 13, the introducing passage 412, 413 are spaced from each other by 180 degrees about an flow-down port 406, and the discharge passages 418, 419 are spaced from the introducing passage 412, 413 by 90 degrees about the flow-down port 406. That is, the discharge passages 418, 419 are displaced from each other by 180 degrees about the flow-down port 406.

The multiple introducing passages 412, 413 allow molten metal to be introduced into the annular groove 414 in a divided manner, which smoothens the introduction of molten metal. Further, the multiple discharge passages 418, 419 allow molten metal to be discharged from the annular groove 414 in a divided manner, which smoothens the discharge of molten metal. The configuration prevents molten metal from flowing into the flow-down port 406 at an early stage of introduction of molten metal at parts of the barrier 416 that are close to the introducing passages 412, 413 or at parts of the barrier that are close to the discharge passages 418, 419. The configuration also prevents the amount of molten metal from unevenly flowing into the flow-down port 406. Accordingly, the temperature of molten metal in the continuous casting mold 404 does not become uneven, and a sufficiently high quality ingot can be continuously casted.

Figure 14A:
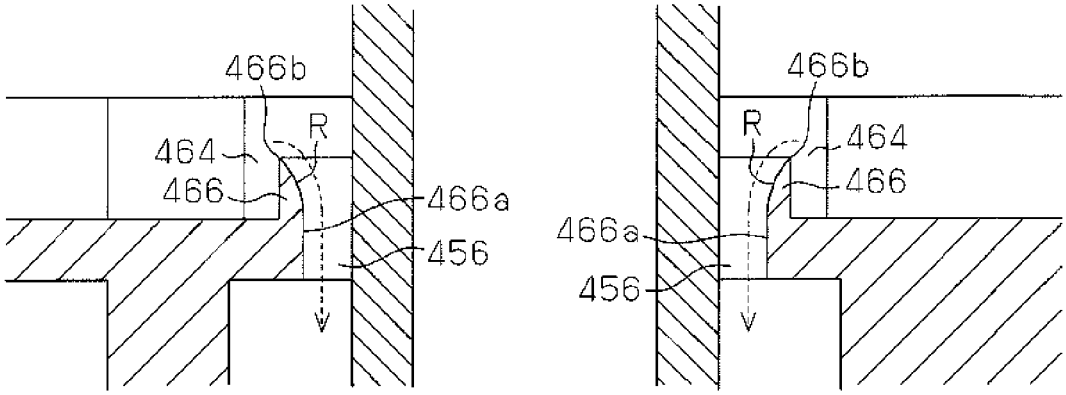
FIGS. 14(*a*) and 14(*b*) are vertical cross-sectional views illustrating a hot-top for continuous casting according to a modified embodiment of the present invention.
Figure 14B:
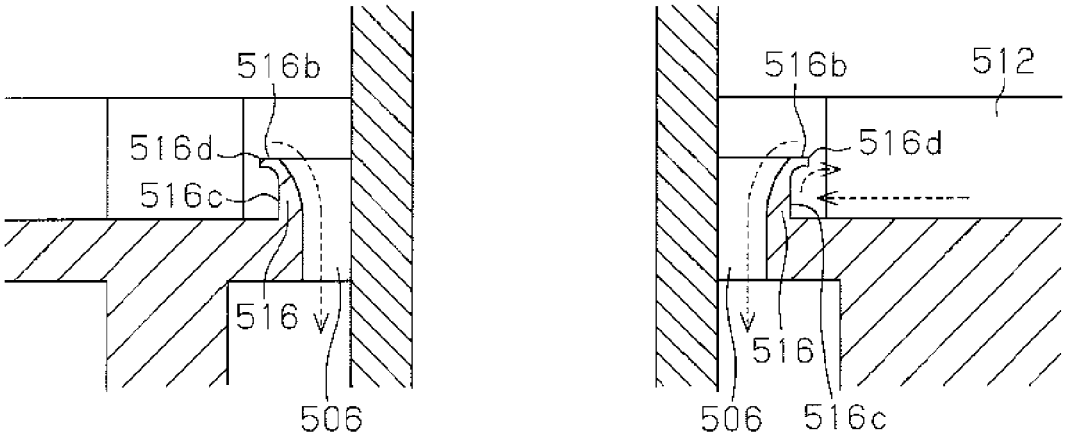

In each of the first to fifth embodiments, the barrier is formed as a wall having a constant thickness. However, as shown in FIG. 14(*a*), the inner surface 466*a* of a barrier 466 may be curved at a tip 466*b* of the barrier 466. Accordingly, when molten metal overflows the annular groove 464 and flows into the flow-down port 456 as indicated by arrows of broken lines, the molten metal smoothly flows along the inner surface 466*a* of the barrier 466 and is prevented from catching air. The configuration prevents the amount of molten metal flowing into the flow-down port 456 from being partially uneven, thereby preventing the temperature of molten metal in the continuous casting mold from being uneven. This allows a sufficiently high quality ingot to be continuously casted.

A barrier 516 shown in FIG. 14(*b*) has an overhang 516*d* at a part of the outer surface 516*c* that is close to the tip 516*b* of the barrier 516. As indicated by arrows, molten metal that flows in from the introducing passage 512 and hits the outer surface 516*c* is returned to the introducing passage 512 by the overhang 516*d*. This prevents the level of molten metal in the introducing passage 512 from being partially high. The configuration further effectively prevents the amount of molten metal flowing into the flow-down port 506 from being partially uneven, thereby preventing the temperature of molten metal in the continuous casting mold from being uneven. This allows a sufficiently high quality ingot to be manufactured.

Figure 15:
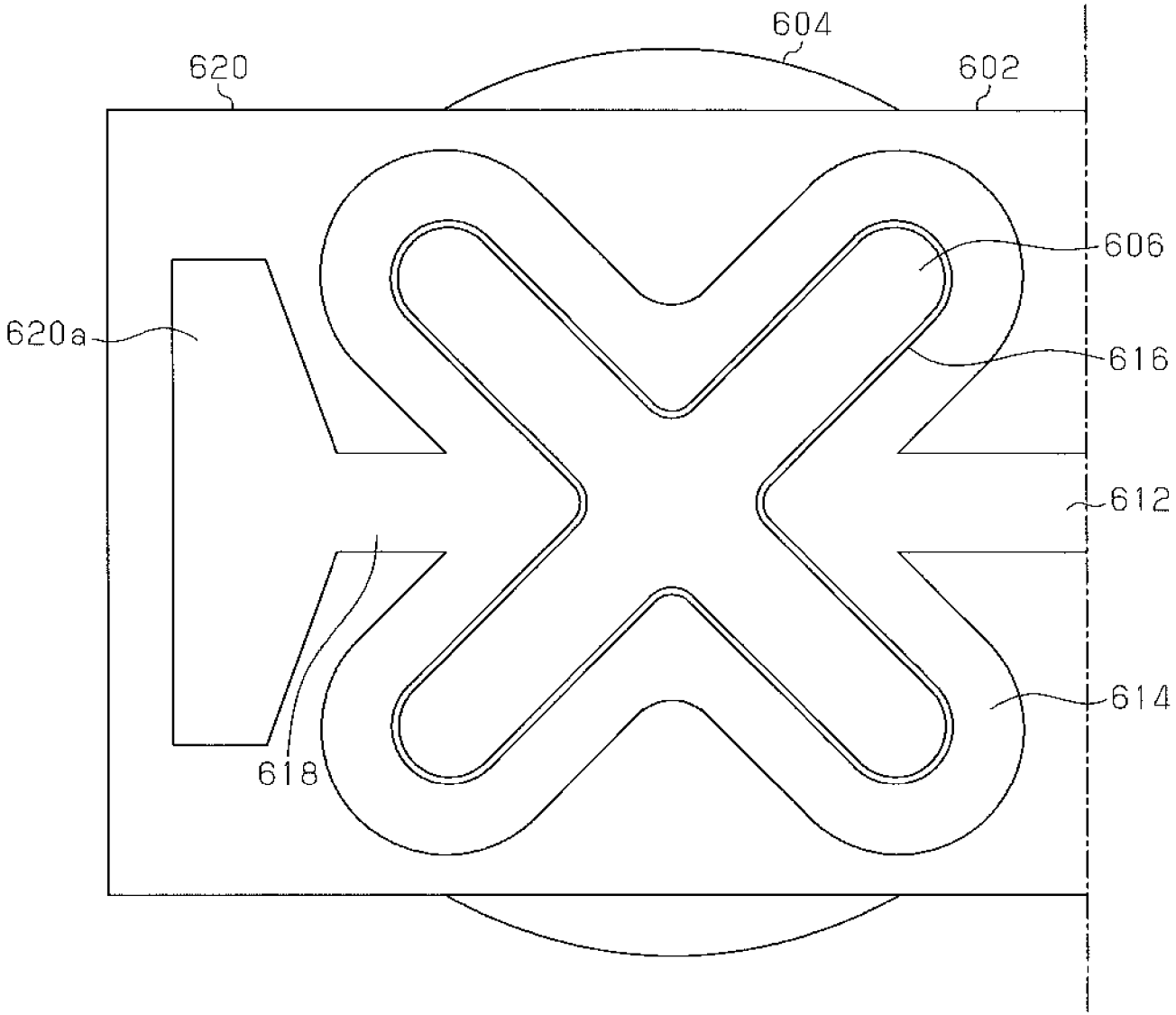
FIG. 15 is a plan view showing a hot-top for continuous casting according to a modified embodiment.

In the first to fifth embodiments, continuous casting hot-top for forming cylindrical ingots are described. The present invention may be applied to cases where other types of ingots are manufactured by continuous casting. FIG. 15 shows an example of a continuous casting hot-top 602 arranged on a continuous casting mold 604 for forming an ingot having a cruciform cross section. In this example, since the ingot is formed to be solid, no core is used. However, a core may be used to obtain a hollow ingot.

The inner shape at the flow-down port corresponds to the inner shape of the cylindrical space forming part. A cruciform loop molten metal introducing space 614 is formed on the periphery of a molten metal flow-down port 606. A cruciform loop barrier 616 is formed between the introducing space 614 and the flow-down port 606.

When molten metal is introduced from a molten metal introducing passage 612, the level of the molten metal does not exceed the barrier 616 at an early stage of introduction of molten metal. The molten metal flows through the introducing space 614 on the periphery of the barrier 616, and flows into a space 620*a* in a molten metal tank 620 via a molten metal discharge passage 618.

Thereafter, when the level of the molten metal rises, the molten metal flows over the barrier 616 from the periphery of the molten metal flow-down port 606 and flows down into the molten metal flow-down port 606. Accordingly, an ingot having a cruciform cross-section is continuously manufactured in the continuous casting mold 604.

Therefore, at an early stage of introduction of molten metal, molten metal does not flow down into the flow-down port 606, but raises the temperature of the continuous casting hot-top 602. Then, molten metal that subsequently flows in overflows the barrier 616 and flows into the continuous casting mold 604, while maintaining a sufficiently high temperature. Further, since the inner shape of a part of the hot-top 602 that forms the flow-down port 606 corresponds to the inner shape of a part of the continuous casting mold 604 that forms a molding space, the molten metal that overflows the barrier 616 and flows down smoothly flows in over the entire circumference of the mold 604. As a result, molten metal the temperature of which is maintained sufficiently high is supplied to the continuous casting mold 604.

Even if the shape of the flow-down port 606, which corresponds to the cross-sectional shape of an ingot to be casted, is complicated, the temperature of molten metal that is poured into the continuous casting mold 604 from the continuous casting hot-top 602 does not become uneven in the mold 604.

The first to fifth embodiments can be applied to a configuration having no core.

The continuous casting hot-top according to the first to fifth embodiments each have a molten metal discharge passage for entirely or partially discharging molten metal from a molten metal introducing space (annular groove) at an early stage of introduction of molten metal. However, the discharge passage may be omitted. In this case, the temperature of the barrier is raised by molten metal accumulated in the molten metal introducing space (annular groove) at an early stage of introduction of molten metal. Thereafter, the molten metal exceeds the barrier, so as to smoothly flow over the entire circumference of the continuous casting mold, so that high temperature molten metal is poured. Therefore, the temperature in the continuous casting mold is prevented from being uneven.

In the first to fifth embodiments, the molten metal introducing space is a groove having a constant width. However, the width may be varied in accordance with the flow rate of molten metal. Further, the molten metal tank may be omitted. In this case, the size of the molten metal introducing space is maximized so that it replaces the function of a molten metal tank.

DESCRIPTION OF THE REFERENCE NUMERALS

M . . . Molten metal,

2, 52, 72, 92, 202, 252, 302, 352, 402, and 602 . . . Continuous casting hot-top

4, 204, 254, 304, 354, 404, and 604 . . . Continuous casting mold,

8, 208, 258 . . . Core

10 . . . Cylindrical space as molding space,

12, 56, 74, 96, 212, 262, 312, 362, 412, 413, 512, 612 . . . Molten metal introducing passage

14, 54, 76, 94, 214, 264, 314, 364, 414, 464, and 614 . . . Annular groove as molten metal introducing space,

16, 62, 82, 98, 216, 266, 267, 316, 366, 416, 466, 516, 616 . . . Barrier,

16*a*, 62*a*, 82*a*, 98*a*, 216*a*, 266*a*, 267*a*, 316*a*, 466*b*, 516*b* . . . Tip,

18, 58, 78, 100, 218, 268, 318, 368, 418, 419, 618 . . . Molten metal discharge passage,

20, 60, 80, 102, 220, 270, 370, 420, 421, 620 . . . Molten metal tank,

54*a*, 76*a*, 214*a* . . . Bottom of molten metal introducing space,

74*a* . . . Bottom of molten metal introducing passage,

78*a*, 94*a* . . . Bottom of molten metal discharge passage,

80*a* . . . Bottom of molten metal tank,

104, 206, 256, 306, 356, 406, 456, 506, 606 . . . Molten metal flow-down port, and

319 . . . Open/close member

The invention claimed is:

1. A hot-top for continuously casting an ingot by pouring molten metal down into a molding space in a continuous casting mold from a molten metal flow-down port, wherein the inner shape of a part of the hot-top that forms the flow-down port is substantially the same as the inner shape of a part of the continuous casting mold that forms the molding space, the hot-top forms a molten metal introducing space about the molten metal flow-down port, and comprises a barrier between the molten metal introducing space and the flow-down port, and the molten metal introducing space is an annular groove that surrounds the molten metal flow-down port, and a tip of the barrier is continuously formed horizontally over the entire circumference of the annular groove, the hot top comprising:

a molten metal introducing passage that opens to the molten metal introducing space to introduce molten metal into the introducing space;

a molten metal discharging passage that opens to the molten metal introducing space to discharge molten metal from the introducing space; and a molten metal tank connected to the molten metal introducing space via the molten metal discharge passage, the tank storing molten metal discharged from the introducing space.

2. The hot-top according to claim 1, wherein the molten metal introducing space has an introducing part into which molten metal is introduced, the bottom of the molten metal introducing space being inclined such that, with the position at the introducing part set to be the highest point, the bottom is gradually lowered as the distance from the introducing part increases.

3. The hot-top according to claim 1, wherein the bottom of the molten metal introducing space is gradually raised as the distance from the barrier increases.

4. The hot-top according to claim 1, wherein the height of the bottom of the molten metal tank is set lower than the height of the bottom of the molten metal introducing space, and the bottom of the molten metal discharge passage is at the same height as the bottom of the molten metal tank or the bottom of the molten metal introducing space, and alternatively, the bottom of the discharge passage is inclined and extends between the bottom of the tank and the introducing space.

5. The hot-top according to claim 1, further comprising:

an open/close member capable of selectively opening and closing the molten metal discharge passage.

6. The hot-top according to claim 1, wherein, at opposite positions with the molten metal flow-down port in between, the molten metal introducing passage and the molten metal discharge passage open to the molten metal introducing space.

7. The hot-top according to claim 1, wherein the barrier is one of a plurality of barriers.

8. The hot-top according to claim 7, wherein the barriers have a double structure that comprises a first barrier and a second barrier that is located radially inside of the first barrier.

9. The hot-top according to claim 1, wherein a core is provided at a center of the molten metal flow-down port.

10. The hot-top according to claim 1, wherein the tip is located at a highest point of the barrier.

11. The hot-top according to claim 10, wherein, when the level of the molten metal reaches the tip of the barrier extending around the entire circumference of the barrier, the molten metal starts overflowing the barrier.

* * * * *